US008814059B2

(12) United States Patent
Wissink et al.

(10) Patent No.: US 8,814,059 B2
(45) Date of Patent: Aug. 26, 2014

(54) ATOMISING DEVICE, ATOMISING BODY AND METHOD OF MANUFACTURING THE SAME

(75) Inventors: Jeroen Mathijn Wissink, Enschede (NL); Iwan Rutger Heskamp, Enschede (NL); Wilhelmus Petrus Johannes De Kruijf, Enschede (NL); Wietze Nijdam, Zutphen (NL); Cornelis Johannes Maria Van Rijn, Hengelo (NL)

(73) Assignee: Medspray XMEMS B.V., Enschede (NL)

( * ) Notice: Subject to any disclaimer, the term of this patent is extended or adjusted under 35 U.S.C. 154(b) by 1184 days.

(21) Appl. No.: 12/666,865

(22) PCT Filed: Jun. 30, 2008

(86) PCT No.: PCT/NL2008/050438
§ 371 (c)(1),
(2), (4) Date: Nov. 16, 2010

(87) PCT Pub. No.: WO2009/002178
PCT Pub. Date: Dec. 31, 2008

(65) Prior Publication Data

US 2011/0049262 A1 Mar. 3, 2011

(30) Foreign Application Priority Data

Jun. 28, 2007 (NL) ..... 2000726

(51) Int. Cl.
*B05B 17/04* (2006.01)

(52) U.S. Cl.
USPC ..... 239/11; 239/543; 239/589; 239/602; 239/DIG. 19; 29/890.142

(58) Field of Classification Search
USPC ..... 239/1, 11, 128, 433, 543, 544, 589, 239/589.1, 602, DIG. 19; 29/890.1, 29/890.142, 890.143
See application file for complete search history.

(56) References Cited

U.S. PATENT DOCUMENTS 5,358,179 A 10/1994 Lund et al.
6,113,013 A * 9/2000 Sand ..... 239/543

(Continued)

FOREIGN PATENT DOCUMENTS

| | | | |
|---|---|---|---|
| FR | 2 851 483 | A1 | 8/2004 |
| GB | 2 271 301 | A | 4/1994 |
| JP | 7-323545 | A | 12/1995 |
| JP | 10-146978 | A | 6/1998 |
| JP | 2006-62373 | A | 3/2006 |
| WO | WO 98/23382 | A1 | 6/1998 |

(Continued)

OTHER PUBLICATIONS

International Search Report, dated Apr. 7, 2009, from corresponding PCT application.

*Primary Examiner* — Steven J Ganey
(74) *Attorney, Agent, or Firm* — Young & Thompson

(57) ABSTRACT

An atomizing device, includes an atomizing body (1) with an inlet (16) for receiving a fluid under increased pressure, and with at least one set of outflow ports (18) for allowing the fluid to escape on a delivery side with forming of a vapor. Imaginary central axes of the outflow ports directed in a flow direction herein enclose a mutual angle (α) in order to intersect each other at an intersection (S). The atomizing body includes a roof (21) and a bottom (11 which extend over at least a first distance (d1) beyond the set of outflow ports (18) and bound a vaporizing space (17) on either side. The intersection (S) of the imaginary central axes of the outflow ports lies at a second distance (d2) from the set of outflow ports, wherein the second distance (d2) is greater than the first distance (d1) and extends beyond the vaporizing space.

15 Claims, 8 Drawing Sheets

(56) References Cited

U.S. PATENT DOCUMENTS

| | | | | |
|---|---|---|---|---|
| 7,152,808 | B2 * | 12/2006 | Jenkins | 239/433 |
| 7,219,849 | B1 * | 5/2007 | Hedger | 239/543 |
| 2007/0063076 | A1 | 3/2007 | Gopalan | |

FOREIGN PATENT DOCUMENTS

| | | | |
|---|---|---|---|
| WO | WO 2005/014175 | A1 | 2/2005 |
| WO | WO 2007/062726 | A2 | 6/2007 |
| WO | WO 2007/104561 | A2 | 9/2007 |

* cited by examiner

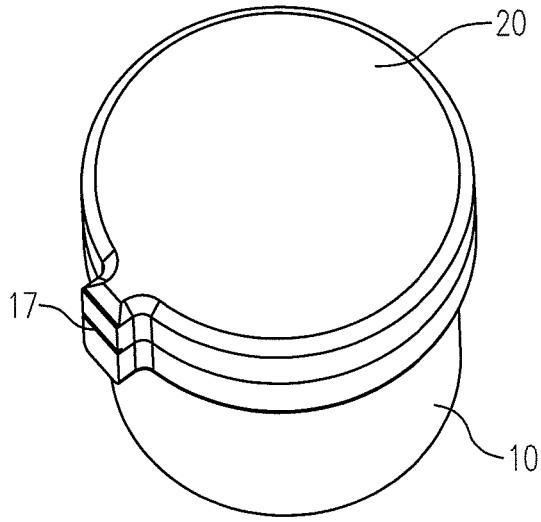
Fig.5A
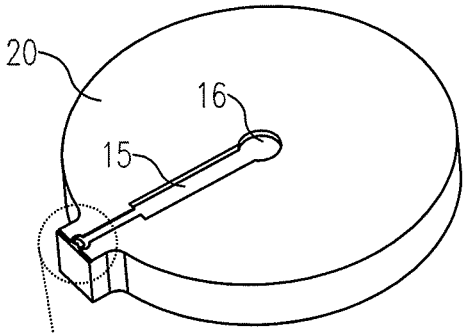
Fig.5B
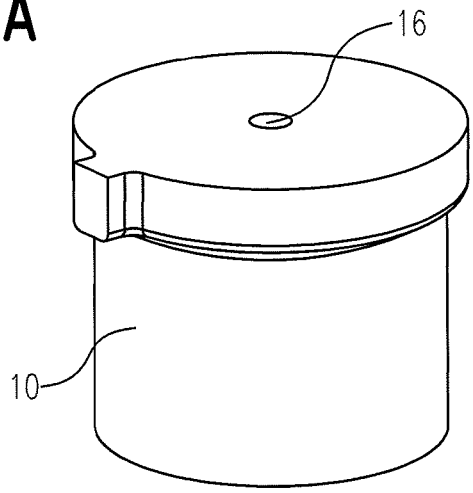
Fig.5C
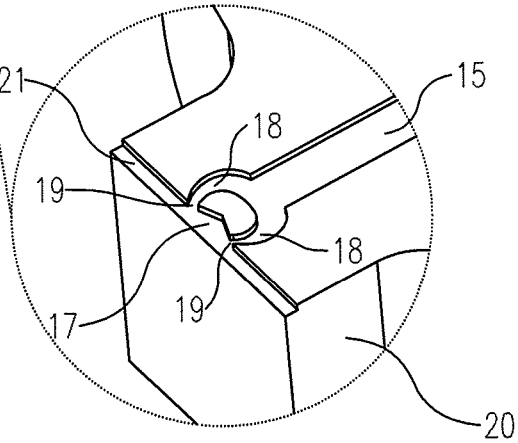

ATOMISING DEVICE, ATOMISING BODY AND METHOD OF MANUFACTURING THE SAME

The present invention relates to an atomizing device, comprising an atomizing body with at least one inlet for receiving a fluid under increased pressure, and with at least one set of outflow ports for allowing the fluid to escape on a delivery side with forming of a vapour, wherein imaginary central axes of the outflow ports directed in a flow direction enclose a mutual angle in order to intersect each other at an intersection. The invention also relates to a method for manufacturing an atomizing device.

An atomizing device of the type described in the preamble is usually applied to form a vapour or mist of finely distributed droplets, in some cases with a relatively narrow size distribution, from a liquid. In addition, such an atomizing device can be applied to form a dispersion or colloidal solution of a fluid in a further fluid.

An atomizing device of the type described in the preamble is known from European patent EP 1.644.129. The known device comprises an atomizing body which is formed from two substantially plate-like substrates, respectively of silicon and glass, which are firmly connected to each other. On a first side the atomizing body comprises an inlet for a liquid for vaporizing and a set of outflow ports on an opposite delivery side. Situated therebetween is a liquid chamber into which a liquid for vaporizing is admitted at an operating pressure in the order of 50-300 bar.

The liquid can escape from the liquid chamber via a set of outflow ports on the delivery side, wherein these outflow ports are oriented at an angle relative to each other. A set of liquid jets making said angle relative to each other and meeting at an intersection outside the body are thus formed on the delivery side. As a result of the collision of the two liquid jets they divide into small droplets at and close to the intersection and thus form a vapour. This process is also referred to as the "impinging jet" principle and has for instance been described by Savart (1833) and Taylor (1959).

Such a device is suitable for many applications for forming a colloidal vapour in air from a fluid, varying from more or less high-quality inhalers for pharmaceutical products, which must provide a very accurate spray pattern with a droplet size within narrow limits in order to optimally enhance absorption of the pharmaceutical product by the body via the airways, to nozzles for spray cans and pumps, in which droplet size is usually greater and in particular less critical. Terms such as vaporizing, spraying, nebulizing and similar terms are otherwise deemed equivalent within the scope of the present patent application and, accordingly, terms such as spray, vapour, aerosol and mist are deemed mutually interchangeable.

In the known device the outflow ports open onto a free main surface of the vaporizing body, which forms an outer boundary of the atomizing body and extends between an upper side and an lower side thereof. Unavoidable tolerances in a manufacturing process of the atomizing body in which this main surface is formed will hereby be of unmistakable influence on a channel length, and thereby on an outflow resistance of the outflow ports. This is the case particularly because the known atomizing body, among other places on the vulnerable delivery side, is released from a greater whole by cleaving, cutting or sawing during manufacture. Not only can this bring about irregularities in the edge of the body, and thereby of the outflow ports, it can also cause contamination of the passage system in the atomizing body due to the entry of substrate particles and applied additives, which may result in blockage and loss. This sets high requirements in respect of the sawing or similar separating process, as indicated in EP 1.644.129. Furthermore, as a result of unavoidable dimensional tolerances the distance from the intersection to the outflow ports may thus possibly vary from atomizing body to atomizing body. This can result particularly in an undesirable asymmetry of the outflow ports. These parameters influence the vaporizing pattern of the device, which has an adverse effect on the reproducibility of the device as a whole and, in the most extreme case, can also result in loss.

The present invention has for its object, among others, to provide an atomizing device of the type stated in the preamble in which such fluctuations are avoided, or at least the influence thereof on operation of the device is significantly reduced, and which moreover allows of considerably simpler precision manufacture. In further aspects the invention has for its object to provide an atomizing device with a fitting envelope and method for manufacture thereof.

In order to achieve the first stated object, an atomizing device of the type described in the preamble has the feature according to a first aspect of the invention that the atomizing body comprises a vaporizing space which is open on the delivery side and into which the at least one set of outflow ports opens, wherein the intersection of the central axes of the outflow ports is located outside the vaporizing space, that the atomizing body comprises at least a first substrate with a substantially flat main surface and a second substrate with a substantially flat main surface, which are mutually connected on their main surfaces, and that at least one of the at least one inlet, the set of outflow ports and the vaporizing space is formed at least partially on at least one of the two said main surfaces.

The edges of the thus present vaporizing space lie outside the reach of the outflow ports. A length, orientation and morphology of the outflow ports is therefore not influenced by variations on or of these edges. The intersection of the two liquid jets is also situated wholly outside the atomizing body and beyond the influence of possible variations in the edges of the vaporizing space. The invention is based here on the insight, among others, that an outflowing liquid jet will form a boundary layer on a boundary surface with a roof and bottom of the vaporizing space, where a speed of the outflowing liquid jet will be low to zero relative to a centre of the liquid jet, whereby no or hardly any changes in speed or variations in flow resistance will occur as a result of possible variations in a distance over which the vaporizing space protrudes relative to the outflow ports.

By making use of an assembly of two substrates combined on their main surface for the atomizing body, the whole structure can be arranged superficially with a high degree of precision and freedom of form in order to thus create a device with a precisely determined, readily reproducible vapour pattern.

Substrate residues, which are released during a sawing process when the atomizing body is separated from a larger whole, are moreover less likely to penetrate the passage system of the atomizing body because the outflow ports are located at a distance from the saw cut. It is thus not necessary to resort to time-consuming and cost-increasing special sawing methods such as in the prior art device, and it is possible if desired to suffice with standard separating techniques such as sawing, (laser) cutting and cleaving. In the design of the outflow ports it is moreover not necessary to take into account a possible fracture line tolerance or similar fluctuations in the manufacturing process, since in the atomizing device according to the invention the side surface onto which the outflow ports open does not bound the atomizing body as such.

A particular embodiment of the atomizing device is characterized here according to the invention in that said substrates form a roof and a bottom of the vaporizing space which extend over at least a first distance beyond the set of outflow ports, and that the intersection of the imaginary central axes of the outflow ports lies at a second distance from the set of outflow ports, this second distance being greater than the first distance. A further embodiment is more particularly characterized in that the second distance is at least about 100 micrometers greater than the first distance. The roof and the bottom thus protrude beyond the outflow ports and receive the vaporizing space therebetween, although the intersection is sufficiently far removed for the break-up of the fluid into small droplets to encounter no, or hardly any, obstruction from the presence of the vaporizing space.

In order to limit an outflow resistance of the fluid, a further preferred embodiment of the atomizing device according to the invention has the feature that a length of the outflow ports is smaller than a transverse dimension thereof, in particular between one and ten times smaller. By thus keeping the outflow ports relatively short in comparison to their diameter an outflow resistance thereof is at least substantially minimal, and thereby a pressure drop over the outflow port during operation, this enhancing the vapour pattern and allowing a lower operating pressure. A particular embodiment of the atomizing device according to the invention has the feature in this respect that the outflow ports have a transverse dimension greater than about 20 micrometers and a length of less than 20 micrometers.

A further preferred embodiment of the atomizing device according to the invention has the feature that a liquid chamber is formed at least partially on at least one of the two said main surfaces, which liquid chamber is in open communication with the at least one inlet and with the at least one set of outflow ports, and that the liquid chamber extends at least substantially as far as an outflow opening of the outflow ports. A length of the outflow ports is here reduced substantially to a minimum in practical manner so that a pressure drop over the port is minimal. Such a structure can be realized with a high degree of precision making use of for instance lithographic techniques as used in semiconductor technology or with micro-electro-mechanical systems (MEMS), micro-nano technology and other high-precision techniques such as LiGA (Lithographie-Galvanoformung-Abformung), precision injection moulding, micro-moulding, electroforming and stereolithography. Particular use can be made here of printing techniques in which a precision stamp acts on a hot, curable substrate, in particular of a thermoplastic plastic.

Such a stamp can for instance be manufactured by imaging and etching the positive surface structure thereof in a (silicon) substrate with a high degree of precision and by using the semiconductor substrate as a casting mould for a body of metal, in particular nickel, to be cast or deposited therein. This metal body then forms the precision stamp to be used, which acts on a hot plastic substrate, for instance of polycarbonate, for the purpose of arranging the described structure of the atomizing body therein, which then cures. Such a precision stamp can otherwise also be realized in numerous other ways within the scope of the invention. If the structure of a series of vaporizing bodies is here pressed simultaneously in a substrate and the individual vaporizing bodies are only separated later, the invention here also provides the advantage that such as separating step will not influence the integrity and operation of the outflow ports, and moreover leaves space for simple, standard separation.

Such techniques also clear the way for more complex outflow port structures which further optimize the operation of the device. A further preferred embodiment of the atomizing device according to the invention has in this respect the feature that the outflow ports are provided in respective wall parts of the atomizing body, which wall parts are oriented at an angle relative to each other and extend at least substantially transversely of a central axis of the outflow port provided therein. The relative orientations and dimensions of both the wall parts and outflow ports can be determined within highly precise limits, whereby it is possible to aspire to and also actually achieve an optimal vaporization. A further particular embodiment of the atomizing device has the feature here that the imaginary central axes of the outflow ports enclose a mutual angle of between 30 and 120 degrees.

A further preferred embodiment of the atomizing device according to the invention is characterized in that the wall parts comprise outflow openings of the outflow ports, wherein the outflow openings are oriented at least substantially transversely relative to the respective imaginary central axes of the outflow ports. A disruptive influence of the outflow port on the spray pattern can thus be reduced, particularly in the case of a relatively short channel length in an outflow port. This has also been found in practice to be a significant advantage relative to the known atomizing device, wherein the outflow openings lie at what is clearly a non-right angle relative to the flow direction through the outflow ports.

Use is generally made in the stated techniques of a starting substrate on which different processes are performed. A further particular embodiment of the atomizing device according to the invention has the feature that the outflow ports are formed monolithically with at least one of the roof and the bottom of the atomizing body. At least one of the two walls as well as the port structure and the inlet are here formed integrally. Further assembly steps and mutual alignments, which could otherwise detract from ease of manufacture and the accuracy of the device, are thus avoided. Using stereolithography in a polymer resin or modern laser-assisted manufacturing techniques, wherein for instance glass or a plastic is illuminated locally and only the illuminated parts are etched away, the whole atomizing body can, if desired, be formed in wholly monolithic manner, i.e. integrally.

A further particular embodiment of the atomizing device has the feature here that the atomizing body comprises at least one substantially plate-like substrate of a material taken from a group comprising plastics, metals, semiconductor materials, in particular silicon, ceramic materials and glass, and that the at least one inlet and the outflow ports are arranged on a main surface of at least one of the at least one substantially plate-like substrate. Said materials are at least highly compatible with the above stated high-precision and semiconductor techniques. The desired internal structure of the atomizing body can thus be realized on the surface, for which purpose it is possible to resort to surface techniques proven in semiconductor technology and in many high-precision processing methods. The surface can then be covered with a further substrate and hermetically connected thereto.

In order to prevent blocking of the outflow ports, a further embodiment of the atomizing device according to the invention has the feature that the inlet is provided with an inlet filter. Such an inlet filter comprises for instance a grid and has passage openings with a transverse dimension of typically more than 20 micrometers. Such a grid can advantageously be formed monolithically together with the inlet and outflow ports in said at least one substrate.

In order to form a finely distributed vapour from a liquid or other fluid, the fluid must be carried through the outflow ports under increased pressure. For this purpose a further particular embodiment of the atomizing device according to the invention has the feature that pressure means are provided for the purpose of presenting the fluid to the at least one inlet at an operating pressure of 1 to 20 bar, at least below about 50 bar. In the device according to the invention such a relatively limited pressure is found to be sufficient for a satisfactory aerosol pattern without having to make use of volatile substances such as propellants or alcohol in order to improve the aerosol pattern. The device according to the invention has moreover been found to be particularly suitable for forming a non-inhalable vapour such as is particularly desirable for vaporizing for instance personal hygiene products such as deodorant, skin sprays and hair spray, and domestic (cleaning) products. In a vapour produced by this embodiment an average droplet size lies manifestly above a critical limit of about 10 micrometers, whereby an inhalable fraction of the thus formed vapour is exceptionally small or even absent. This makes a significant contribution toward the safety and the enjoyment of use for the end user.

In addition to a monolithic structure realized with semiconductor precision, the invention is also suitable for low-precision implementation, whereby a considerable cost price reduction can be achieved and less stringent manufacturing conditions are required. A second aspect of the invention therefore has for its object, among others, to provide an atomizing device which, while retaining at least some of the above stated advantages, can be realized at relatively low cost price and with relatively simple manufacturing techniques.

In order to achieve this object, an atomizing device comprising an atomizing body with at least one inlet for receiving a fluid under increased pressure and with at least one set of outflow ports to allow the fluid to escape on a delivery side with forming of a vapour, wherein imaginary central axes of the outflow ports directed in a flow direction enclose a mutual angle in order to intersect each other at an intersection, wherein the atomizing body comprises a vaporizing space which is open on the delivery side and into which the at least one set of outflow ports opens, which vaporizing space is bounded on opposite sides transversely of a delivery side and wherein the intersection of the central axes of the outflow ports is located outside the vaporizing space, has the feature according to the invention that the atomizing body comprises on the delivery side an insert which, at least in a plane formed by the central axes, bounds a cup-like recess which forms the vaporizing space, wherein the set of outflow ports is arranged in opposite wall parts of said recess. Such an insert can be manufactured individually as a separate component and then assembled with the other part of the atomizing body. The requirements set herefor are not per se stringent. A particular embodiment is characterized in this respect in that the insert comprises a metal plate part, and more particularly that the recess is punched into the plate part. Such a plate part and punching technique are relatively low-precision and can be realized in a relatively simple production environment.

In a further embodiment the atomizing device according to the invention is characterized here in that the wall parts extend from a concave surface, in particular a cylindrical surface or a spherical surface. Such a spherical form has the advantage here relative to a cylindrical form that the outflow ports are always correctly aligned relative to each other so that both liquid jets will always strike each other at the intersection. Although the final vapour pattern may here become slightly askew, this will not be perceptible, or hardly so, for many applications and so not pose a problem. With other forms, such as an angular wall or cylinder wall, the mutual alignment of the outflow ports is more precise in order to ensure that the liquid jets actually meet each other.

According to further aspect, the invention has for its object, among others, to provide an atomizing device with an atomizing body which is embedded in a fitting envelope, and a method for realizing this.

In order to achieve this object an atomizing device comprising an atomizing body with at least one inlet for receiving a fluid under increased pressure and at least one outflow port for allowing the fluid to escape on a delivery side with forming of droplets formed at least partially therefrom, wherein the atomizing body is received in an envelope comprising at least one envelope part with at least a part of a seating for the atomizing body, has the feature according to a further aspect of the invention that the atomizing body is able and adapted to capture a supplied radiation, thus forming heat, that the atomizing body in the seating is accessible to the supplied radiation, and that provided on a boundary surface between the envelope and the atomizing body is a boundary layer which has entered into heat-exchanging contact with the atomizing body and under the influence thereof has brought about a practically hermetic adhesion between the atomizing body and the envelope.

An adhesion of the envelope to the atomizing body, and thereby a mutual fixation and sealing, is thus achieved by providing said radiation after the atomizing body and the envelope have been joined together. A completely contact-free heating is thus possible, which takes place substantially locally and thereby leaves a mutual, initial positioning of the two parts intact and requires relatively little energy. The envelope adhered to the atomizing body herein moreover ensures a seamless seal with the atomizing body so that the atomizing body is fixed in the envelope in leakage-free manner and the device is ready for possible further finishing. As well as being used for non-inhalable sprays, such an envelope can also be applied for inhalable sprays and is in principle suitable for any type of atomizing body, varying from the above described type on the basis of colliding liquid jets to vaporizing bodies in which a fine vapour is formed from a liquid by so-called Rayleigh break-up or by atomization, as well as to emulsifiers with which liquids can be introduced colloidally into other liquids in order to thus realize various (co-)emulsions.

In a preferred embodiment the envelope comprises at least on a delivery side of the atomizing body a spacer part which is able and adapted, under all conceivable conditions, to maintain a distance from the seating in which the atomizing body is received. If a number of thus enveloped vaporizing bodies are stored together in a storage box or in other manner, i.e. not in a single packaging, an atomizing body is sufficiently recessed and protected in an envelope to prevent the vulnerable outflow ports of the atomizing body coming into contact with a part of another atomizing device during storage or transport.

A particular embodiment of the atomizing device according to the invention is characterized in that the at least one envelope part comprises a thermoplastic material and that the boundary layer comprises a top layer of the envelope part which is melted around the atomizing body. A further particular embodiment of the atomizing device according to the invention has the feature here that the envelope comprises at least two mutually connected envelope parts which bound the seating at the position of the atomizing body and are fused together, thus enclosing the atomizing body. Here the same advantages not only apply between the atomizing body and the envelope, but also between the envelope parts relative to each other. Making the envelope parts from the same at least compatible material moreover enhances a durable and seamless mutual fusing. For this purpose a further particular embodiment of the atomizing device according to the invention has the feature that the envelope parts comprise at least in the boundary layer a thermoplastic plastic, particularly one from a group of polyolefins and polyamides.

Such a fusing of the atomizing body can cause lateral shrinkage and stress around the seating. In order to prevent the envelope being pulled away from the atomizing body as a result thereof, a further preferred embodiment of the atomizing device according to the invention has the feature that the envelope part comprises on the main surface an edge part bounding the seating, and that the edge part is separated by a groove from a further-removed part of the envelope part. A possible tensile force which could otherwise be exerted on the adhesion of the atomizing body in the seating by the further-removed part of the envelope part is thus effectively interrupted by the groove. A further preferred embodiment of the atomizing device has the feature here according to the invention that the edge part at least substantially wholly surrounds the seating. A further embodiment more particularly has the feature that the groove has a depth which is at least substantially equal to a depth of the seating. An effective stress interruption is thus realized on all sides over at least substantially a full depth of the seating. A groove depth of roughly two thirds of the depth of the seating is here deemed to be sufficient.

Instead of via at least a boundary layer of a thermoplastic plastic, the adhesion between the envelope and the atomizing body can also be realized in other thermally activated manner. Use is made hereof in a further particular embodiment of the atomizing device according to the invention, which is characterized in that the boundary layer comprises a thermosetting glue layer which is applied between the envelope part and the atomizing body and which, in hardened state, connects the envelope part and the atomizing body. For the hardened boundary layer use can for instance be made of a thermally setting glue, such as for instance an epoxy glue, which has been thermally activated.

The intended absorption of radiation by the atomizing body can be of different nature in a physical sense. Use can thus be made of different forms of electromagnetic capture, wherein use is made of an electrical (semi)conductor material for the atomizing body. The chosen material and the nature and frequency of the radiation can be adjusted to each other relatively accurately in a manner such that electromagnetic absorption occurs in the atomizing body, wherein particles in the material are moved more rapidly and so rise in temperature. The frequency of the radiation must here be adjusted within relatively narrow limits to the particles for displacing. Such a mechanism occurs for instance in relatively high-frequency microwave radiation, and dipole materials which can be moved more rapidly thereby.

Use can also be made of the generation of induction currents in the atomizing body in order to increase the temperature thereof. It has been found in practice that particularly high local temperature increases can hereby be achieved in a short time which are sufficient for fusing of some envelope materials. With a view hereto, a further preferred embodiment of the atomizing device according to the invention has the feature that the atomizing body comprises an electrically conductive material, in particular one from a group comprising metals and semiconductor materials. The conductivity of these materials allows a supplied electromagnetic alternating field to be captured therein and to generate induction currents. Other than in electromagnetic resonance, the chosen frequency of the supplied radiation is less critical here, and can be significantly lower. In a further preferred embodiment the atomizing body herein has the feature that the atomizing body is formed at least partially from silicon. In addition to the electrical and thermal conductivity, this material provides many advantages from a production engineering viewpoint because modern semiconductor technology and micro to nanomechanics are widely adapted to this material.

In addition to such an electromagnetic capture, use can also be made of optical absorption within the scope of the invention. For this purpose a particular embodiment of the atomizing device according to the invention has the feature that the atomizing body is optically absorbent and that up to the atomizing body the envelope comprises at least a window which is substantially transparent to the supplied radiation. This embodiment is suitable for local heating of the atomizing body under the influence of light which is supplied with a sufficient power, for instance making use of a laser. Because the atomizing body here does not have to be electrically conductive per se, a wide range of optically absorbent materials can be applied for this purpose, including isolators.

Particularly for applications in inhaler devices, wherein on the delivery side of the atomizing body a transverse airflow is supplied to which the formed vapour is relinquished, a further preferred embodiment of the atomizing device according to the invention has the feature that the atomizing body is at least substantially plate-like and is bounded by at least substantially flat main surfaces onto which the at least one inlet and the at least one outflow port open, and that on the delivery side a main surface of the atomizing body at least substantially coincides with the main surface of the envelope part. The atomizing body thus lies substantially flush with the main surface of the envelope part so that the atomizing body disrupts a transverse airflow along the delivery side as little as possible.

A method for manufacturing an atomizing device, wherein an atomizing body is placed in a seating provided for this purpose in an envelope part and fixed therein, has the feature according to the invention that the atomizing body is placed in the seating in direct heat-exchanging contact with a boundary layer, that the atomizing body is subjected to radiation of a nature and frequency which is captured by the atomizing body with generation of heat, and that the atomizing body is fixed in the seating by causing the boundary layer to enter into a durable adhesion with at least the atomizing body under the influence of the heat developed in the atomizing body. A wholly contact-free and seamless fixation of the atomizing body in an envelope is thus possible, so that a hermetically sealed whole is finally obtained. This provides considerable advantages relative to conventional methods of manufacture wherein the atomizing body and the envelope must be glued via for instance a contact glue.

A particular embodiment of the method according to the invention herein has the feature that a first and a second envelope part envelop the seating on a mutual contact surface and are joined together to form a releasable assembly while enclosing the atomizing body, that use is made for the envelope parts of envelope parts which comprise a thermoplastic plastic on at least the contact surface, and that the assembly is subjected to a treatment with said radiation in order to fuse together the whole at least at the position of the atomizing body under the influence of the heat developed in the atomizing body. The atomizing body is here first enclosed releasably between the two envelope parts, wherein a certain degree of freedom is still present for a mutual repositioning and alignment. Once correctly assembled, the whole is then subjected to a contact-free heating step which avoids disruption of the mutual positioning of the components.

A further embodiment of the method according to the invention has the feature that the atomizing body is placed in the seating via a thermally setting boundary layer and that the boundary layer is set under the influence of the heat developed in the atomizing body. The envelope therefore need have no thermoplastic properties per se, and use can be made of a commercially available, thermally setting glue, for instance on epoxy basis, which is further activated in contact-free manner under the influence of heat relinquished by the atomizing body.

In a further particular embodiment the method according to the invention is herein characterized in that use is made for the atomizing body of an electrically conductive material, in particular a metal or semiconductor material, and that the assembly is subjected to electromagnetic radiation, in particular microwaves, of a nature and frequency which at least substantially passes through the envelope part but which is captured by the atomizing body with generation of heat. The at least one envelope part can here be integrally permeable to the supplied radiation, i.e. be fully transparent or at least translucent to the supplied radiation, or locally comprise a window which exposes the atomizing body to the supplied radiation. The envelope part on the one hand thus allows passage of the supplied radiation but softens and melts under the influence of the heat generated in the atomizing body on a boundary surface therewith.

A further particular embodiment of the method according to the invention has the feature that use is made for the atomizing body of an optically absorbent material and that a high-energy light beam is directed at the atomizing body with a light source, in particular a laser. Here also the at least one envelope part can optionally be integrally transparent to the supplied laser radiation or locally comprise a window in which the atomizing body is visible. The heat which is released by the laser radiation being absorbed by the atomizing body also provides in this embodiment a seamless fusing of the atomizing body at the boundary surface with the envelope.

The invention also relates to an atomizing body as can be applied in the above described atomizing device according to the invention, and will now be further described on the basis of a number of exemplary embodiments and an accompanying drawing. In the drawing.

Figure 4A:
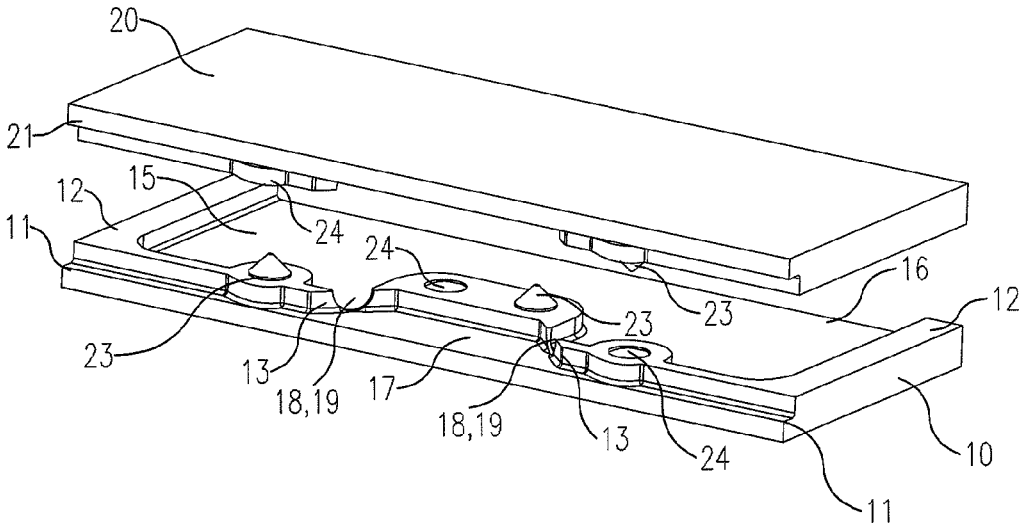
FIG. 4A shows a perspective view of a second exemplary embodiment of an atomizing device according to the first aspect of the invention.
Figure 4B:
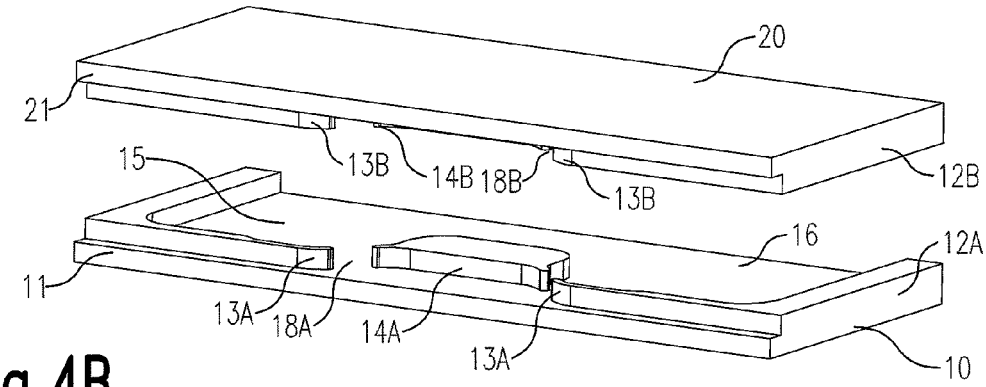
FIG. 4B shows a perspective view of a third exemplary embodiment of an atomizing device according to the first aspect of the invention.
Figure 4C:
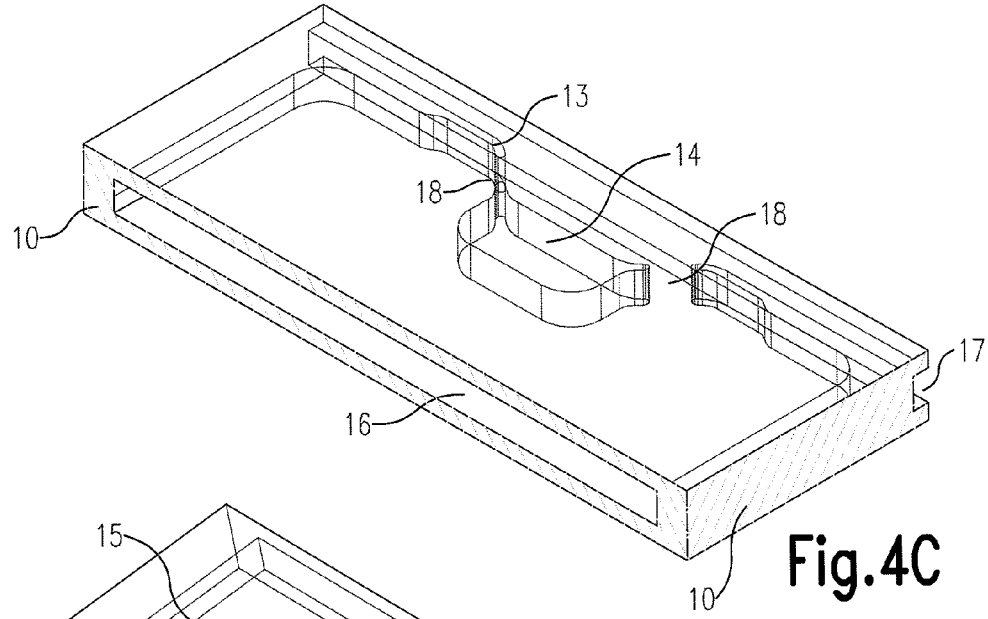
Figure 4D:
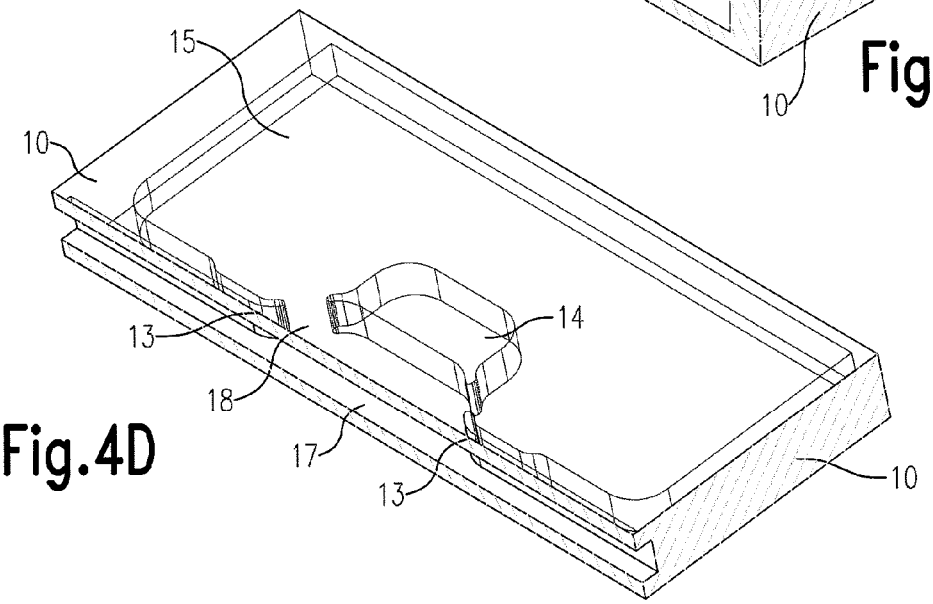
Figure 6A:
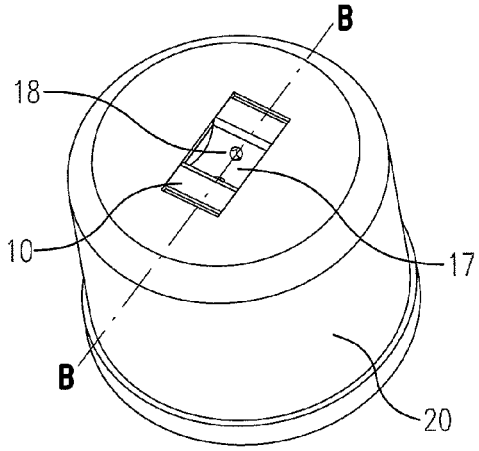
Figure 6B:
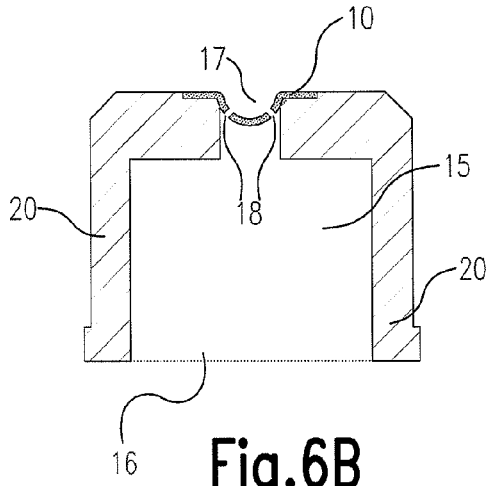
Figure 7A:
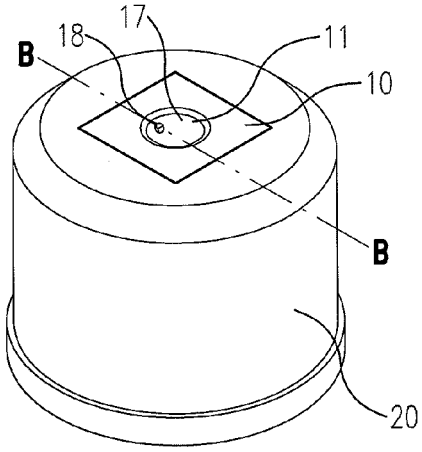
Figure 7B:
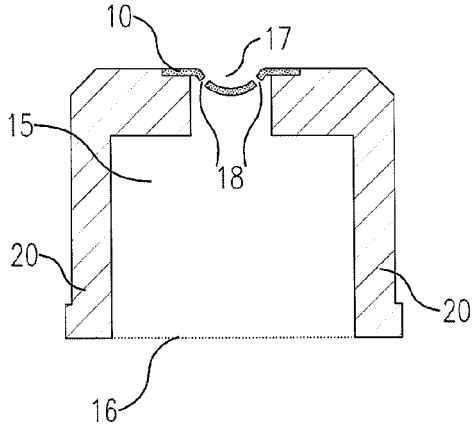
Figure 8:
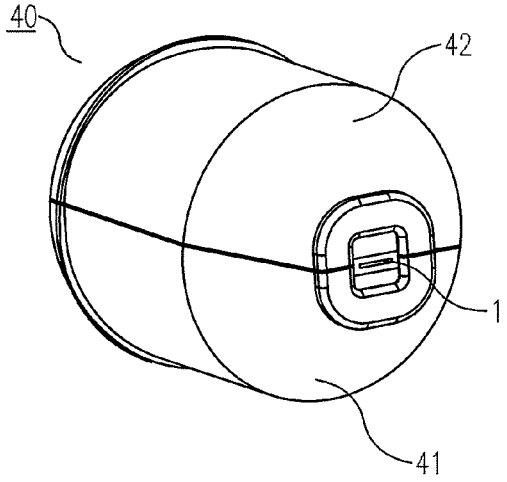
Figure 9:
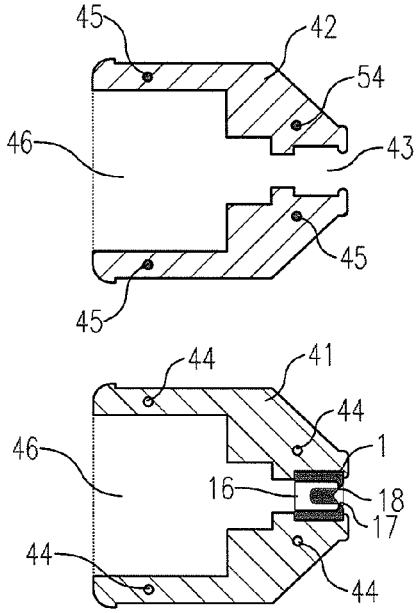
Figure 10:
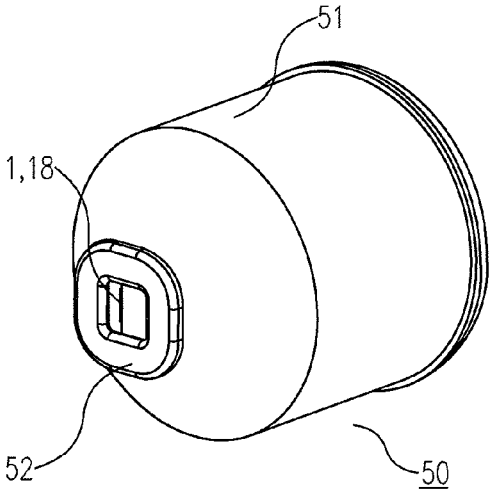
Figure 11:
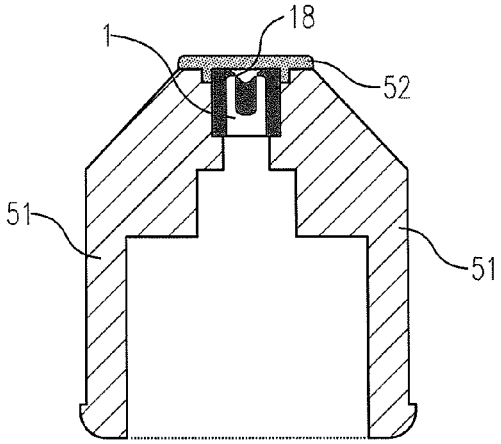
Figure 12A:
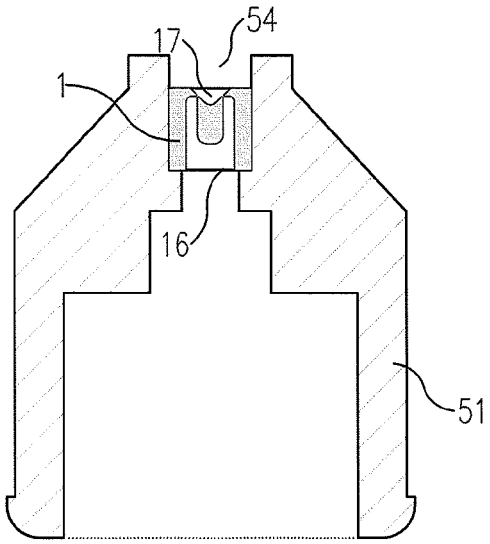
Figure 12B:
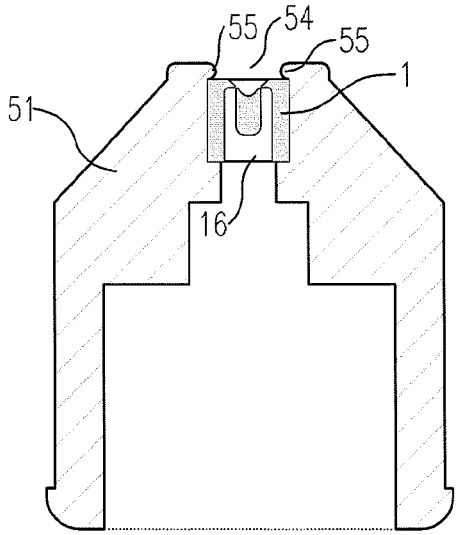
Figure 13:
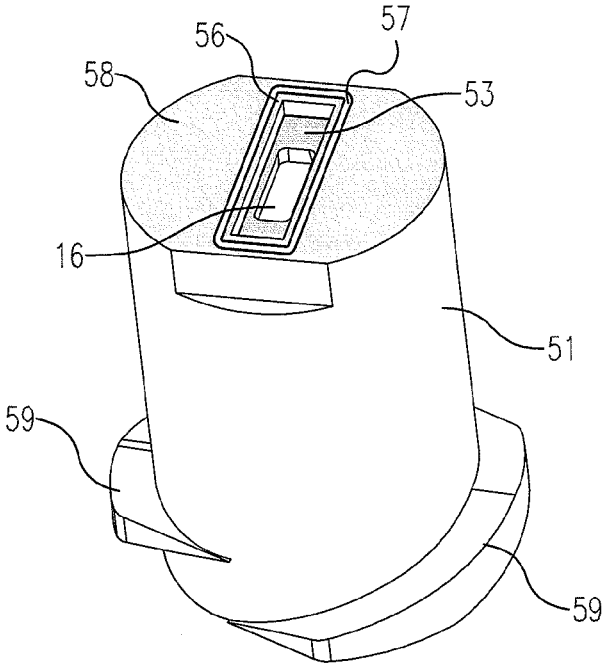
Figure 14A:
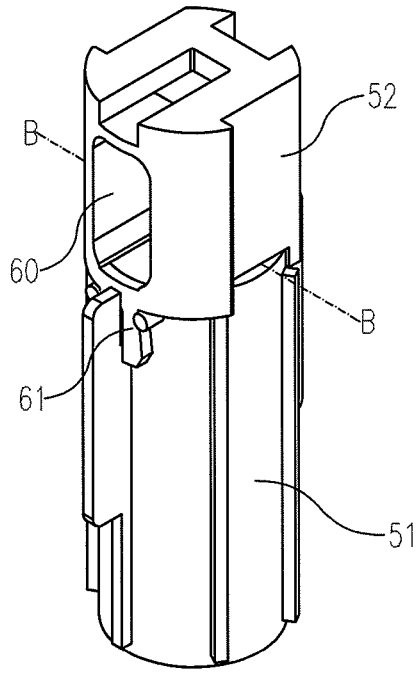
Figure 14B:
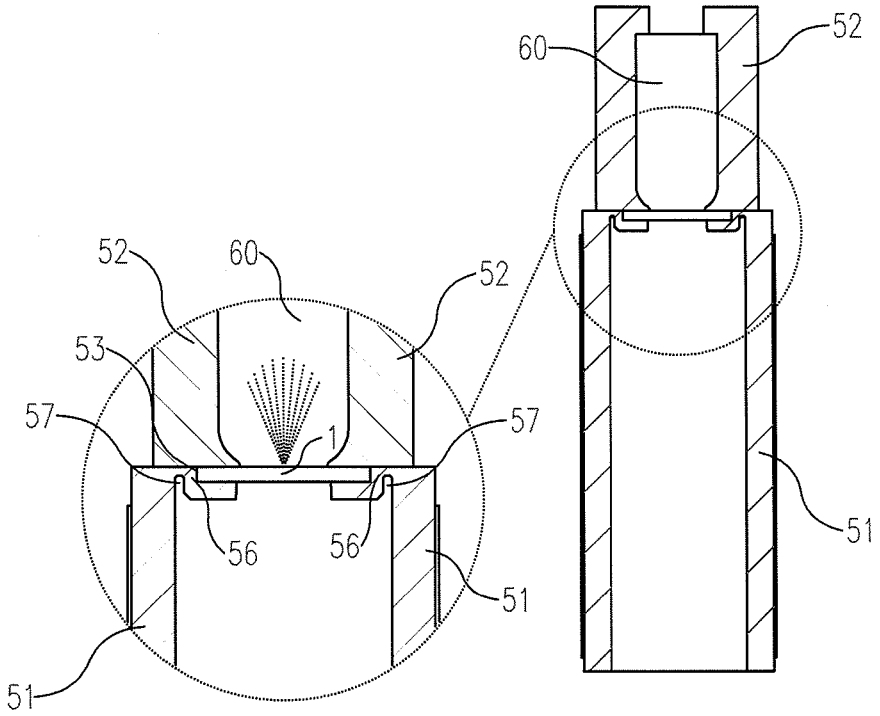

FIGS. 4C-D show a perspective view of a fourth exemplary embodiment of an atomizing device according to the first aspect of the invention;

FIGS. 5A-C show a perspective view of a fifth exemplary embodiment of the atomizing device according to the invention, respectively in assembled situation and constituent parts;

FIGS. 6A-B show respectively a perspective view and a cross-section along line B-B of a sixth exemplary embodiment of an atomizing device according to the first aspect of the invention;

FIGS. 7A-B show respectively a perspective view and a cross-section along line B-B of a seventh exemplary embodiment of an atomizing device according to the first aspect of the invention;

FIG. 8 shows a perspective view of an atomizing body of a first embodiment of an atomizing device according to the further aspect of the invention in a fitting envelope;

FIG. 9 shows two cross-sections of the atomizing device of FIG. 8;

FIG. 10 shows a perspective view of an atomizing body of a second embodiment of an atomizing device according to the second aspect of the invention in a fitting envelope;

FIG. 11 shows a cross-section of the atomizing device of FIG. 10;

FIGS. 12A-B show a cross-section of an atomizing body of a third exemplary embodiment of an atomizing device according to a further aspect of the invention, respectively before and after being fixed in a fitting envelope;

FIG. 13 shows a perspective view of a fourth exemplary embodiment of an atomizing device according to the invention; and FIGS. 14A-B show respectively a perspective view and a cross-section of a further exemplary embodiment of an atomizing device according to the invention.

The figures are purely schematic and not drawn to scale. Some dimensions in particular are exaggerated to greater or lesser extent for the sake of clarity. Corresponding parts are designated in the figures with the same reference numeral.

Figure 1:
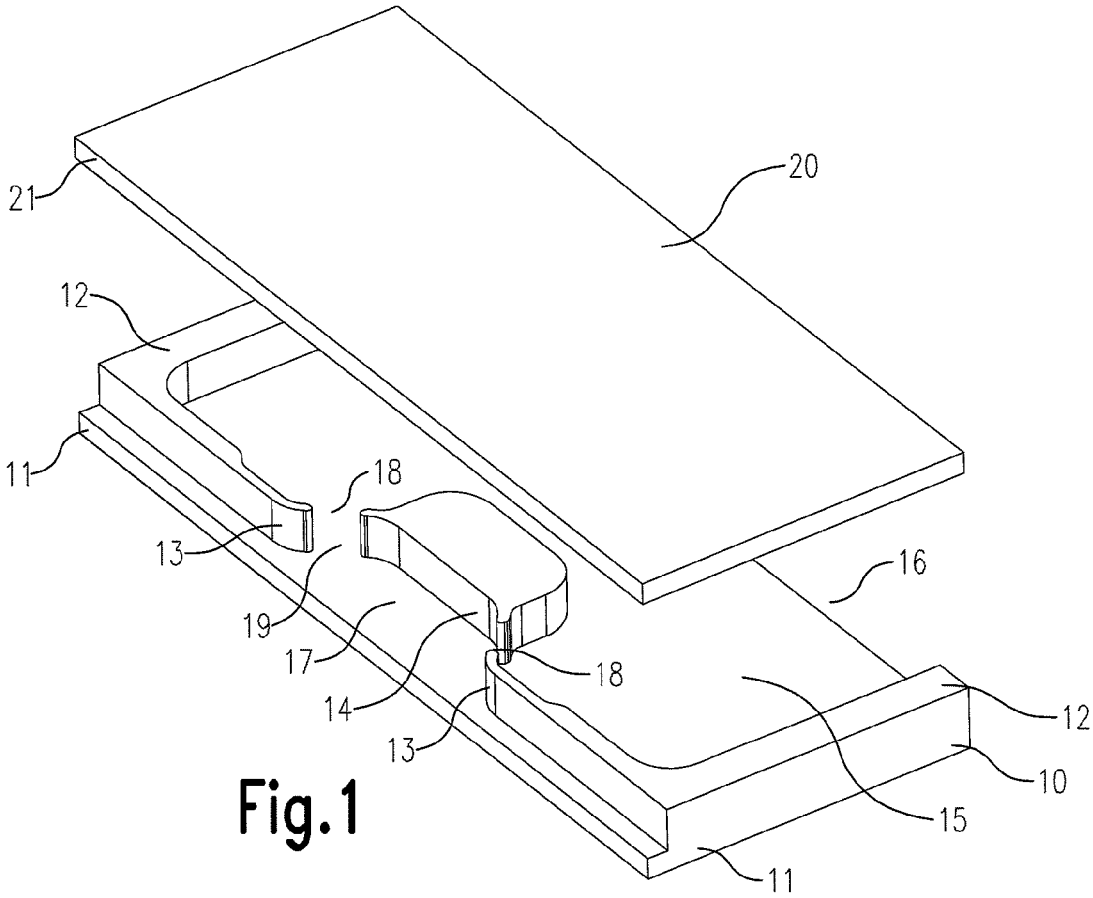
FIG. 1 shows a perspective view of constituent parts of a first exemplary embodiment of an atomizing device according to a first aspect of the invention.
Figure 2:
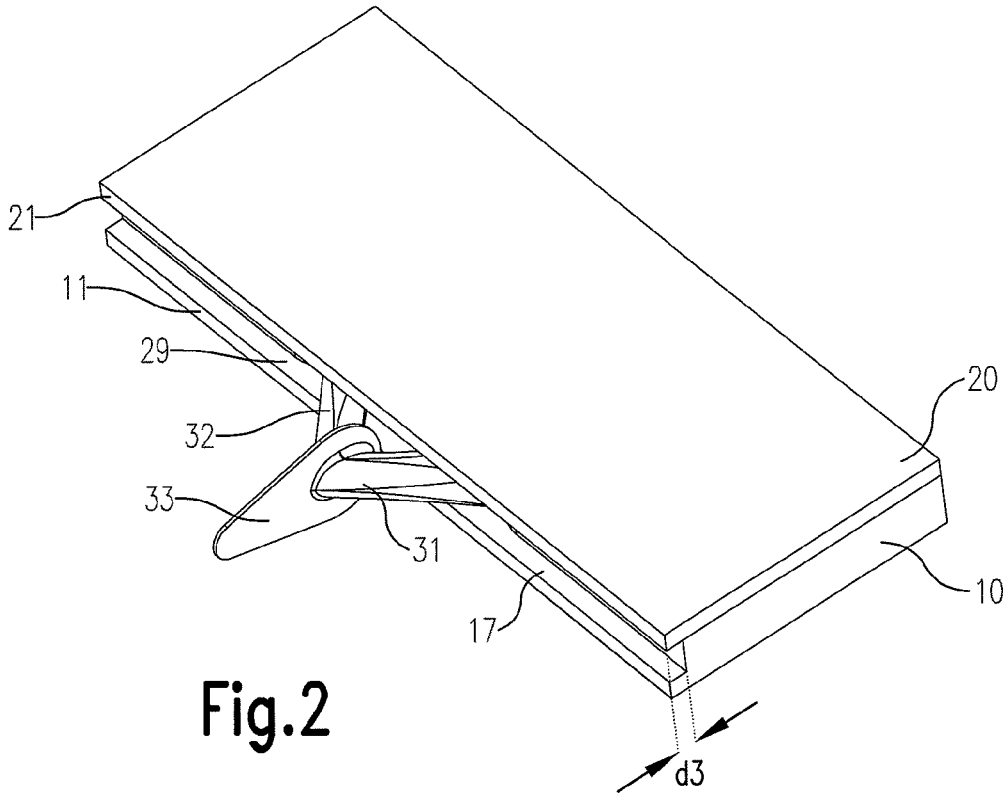
FIG. 2 shows a perspective view of the assembled atomizing device of FIG. 1.
Figure 3:
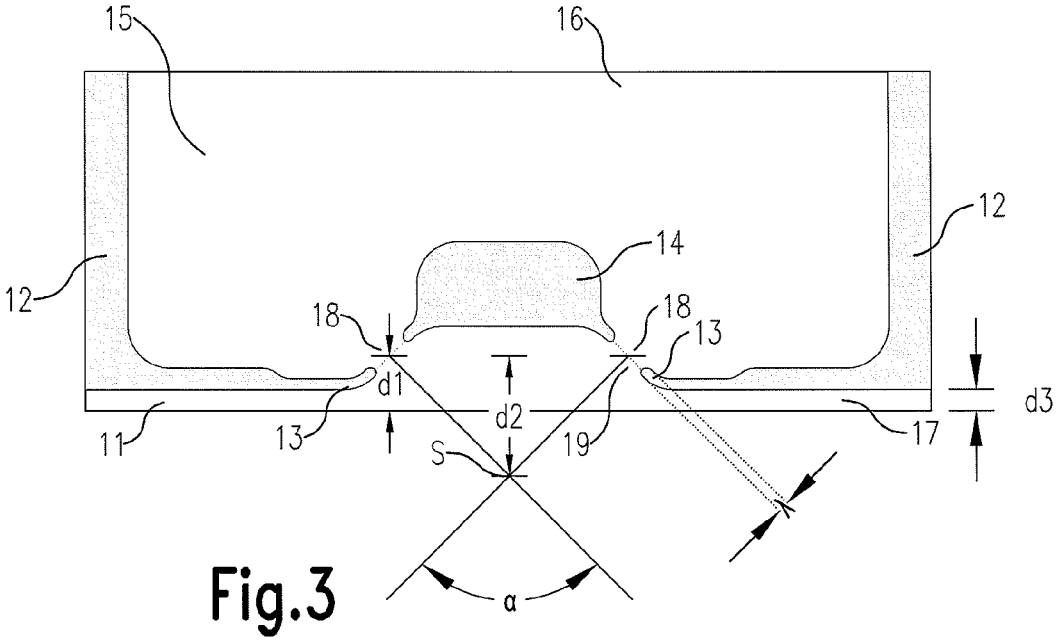
FIG. 3 shows a top view of a bottom part of the atomizing device of FIG. 1.

FIG. 1 shows two constituent parts of an atomizing body 1 of an atomizing device according to a first exemplary embodiment of the invention, which is shown respectively in FIGS. 2 and 3 as assembled whole and in cross-section. Use is made in this example of two parts 10,20 of silicon or glass due to the compatibility of these materials with modern lithographic techniques such as are used in semiconductor technology or with micro-electro-mechanical systems (MEMS) and other high-precision techniques such as LiGA (Lithographie-Galvanoformung-Abformung), precision injection moulding, micro-moulding, electroforming and stereolithography.

A bottom part 10 of the atomizing body is formed wholly monolithically by etching from a silicon substrate and comprises, in addition to a bottom 11, a structure of walls 12-14 which together bound a liquid cavity 15. On a first inlet side liquid cavity 15 is in open communication with an inlet 16 which, if desired, is provided with a simultaneously formed inlet filter in the form of a grid structure etched out of the substrate. During operation a fluid for vaporizing is admitted via inlet 16 into the liquid cavity under increased pressure in the order of 1-20 bar, at least below 50 bar. The atomizing device comprises for this purpose pressure means and feed means (not further shown) outside the atomizing body.

On a delivery side bottom part 10 comprises a set of outflow ports 18 into which liquid cavity 15 debouches in order to allow a fluid in the form of two jets 31,32 directed toward each other to escape from a set of outflow openings 19, see also FIG. 2, with forming of a vapour 33. Outflow ports 18 are situated here in respective wall parts 13,14, which are here oriented relative to each other such that imaginary central axes of the outflow ports directed in a flow direction enclose a mutual angle $\alpha$ and intersect at an intersection S, see FIG. 3. This angle lies typically between 30 and 120 degrees and amounts here to about 90 degrees. A height and a width of the outflow ports lie typically between about 20 and 100 micrometers and both amount in this example to about 30 micrometers.

Owing to the photolithographic masking techniques and etching processes taken from semiconductor technology the bottom structure shown in FIG. 1 can be manufactured entirely as one monolithic whole with an extremely high degree of precision. The structure is closed with a plate-like roof part 20 which forms a roof 21 of the atomizing body and which is connected in leakage-tight manner to bottom part 10. For roof part 20 use can also be made of silicon or glass, although it is also possible, if desired, to opt for another material, such as a metal or polymer. The thus obtained atomizing body is shown in FIG. 2.

If a liquid or other fluid is admitted into the atomizing body under increased pressure, the liquid will escape at the set of outflow ports 18 with forming of two liquid jets 31,32 which meet each other in or close to intersection S. As a result the colliding liquid jets 31,32 break up into fine droplets which are colloidally suspended in the ambient air to form a fine vapour 33. It has been shown that a size distribution of the thus formed vapour droplets lies within relatively accurate limits around 10 to 100 micrometers, whereby the device according to the invention is particularly suitable for non-inhalable sprays, both in propellant-containing spray cans and in propellant-free pumping cans.

Apart from the inlet pressure and the nature of the liquid, the vapour pattern depends mainly on the port structure 18,19 and the surface morphology of wall structure 13,14 of the atomizing body on the delivery side. Because these structures are determined in wholly photolithographic manner and with a high degree of precision, the device can be manufactured with an extremely high reproducibility, wherein the vapour pattern will not vary from device to device, or hardly so. Contributing to this is the fact that the vaporization in the device according to the invention takes place between a protective structure of projecting parts of roof 21 and bottom 11, which protrude a distance d3 beyond the side wall structure 13,14. This is shown in detail in FIG. 3.

Owing to the invention the atomizing body comprises a vaporizing space 17 for receiving the liquid jets therein which is located outside outflow ports 18 and which is bounded on opposite sides by the roof and the bottom of the atomizing body, but which is fully open on the delivery side in order to allow escape of the set of liquid jets directed toward each other. The intersection S of the escaping liquid jets lies here at a greater distance from outflow ports 18 than the distance over which the roof and the bottom extend beyond outflow ports 18 and is thus outside the vaporizing space 17 bounded on either side by the roof and the bottom. A separating operation, wherein the atomizing body is separated from a larger whole along an outer edge of the roof and the bottom, hereby has hardly any influence on the operation, and in particular the vaporizing properties, of the atomizing body, whereby it can be manufactured on industrial scale with extremely high reproducibility and output.

Both bottom 11 and roof 21 of the atomizing body extend a distance d1 beyond outflow ports 18, while intersection S of colliding liquid jets 31,32 is located a distance d2 from the same ports 18. In this example the first distance d1 amounts to about 30 micrometers and the intersection lies about 60 micrometers from ports 18. A possible slight variation in the length d1 has been found in practice not to disrupt the vapour pattern of the device at all. Possible edge finishings or for instance variations in a cutting, sawing or cleaving process for separating the atomizing body from a larger whole here do not therefore affect the vapour pattern of the final device.

Because the structure of outflow ports 18 can thus be determined in wholly photolithographic, micromechanical or other manner with a very high degree of precision and particularly because a break line running therethrough does not have to be taken into account, ports 18 can be provided with a relatively short channel length. In the present example this is achieved in that liquid chamber 15 extends to a distance λ, of only about 5 micrometers from outflow openings 19 of outflow ports 18, see FIG. 3. The outflowing liquid thus need only bridge a channel length λ, of a mere five micrometers in ports 18 before flowing out at outflow openings 19. This is less than the transverse dimensions of the outflow ports, whereby the outflow ports cause no, or hardly any, flow resistance and pressure drop for the outflowing liquid, and the liquid can flow out at high speed.

An atomizing body of a second embodiment of an atomizing device according to the invention is shown in FIG. 4A. The structure is largely similar to that of the first exemplary embodiment, although it is manufactured in this case wholly from plastic. Use is made for this purpose in this example of two injection-moulded parts 10,20 which are formed from a suitable thermoplastic plastic, in particular polycarbonate, a polyamide or a polyolefin, such as polyethylene, polypropylene and in particular TOPAS COC, commercially available under this brand-name, or other amorphous plastic. Parts 10,20 are both provided with snap members 23 and complementary snap cavities 24, with which a bottom part 10,11 and a roof part 20,21 can be snapped onto each other. Via a suitable gluing or through mutual fusing a firm and leakage-free assembly is thus created with an inlet 16 for receiving a liquid under increased pressure and a set of outflow ports 18,19 for allowing the liquid to escape from a liquid cavity 15 in the form of a set of colliding jets. Liquid cavity 15 is situated within this assembly and is bounded laterally by wall parts 12,13, which are formed monolithically with bottom part 10.

At the position of their mutual intersection the jets entering each other break up into a fine vapour. This intersection here also lies outside the boundaries of a roof 21 and a bottom 11 formed by protruding parts of the two body parts 10,20, while outflow ports 18 lie within this boundary. Injection moulding techniques offer a great freedom of form, this being manifest here in, among other parts, the round outflow openings 19 and cylindrical outflow ports 18 used here. Although the accuracy of the thus obtained structure will be less than the extremely high precision of the semiconductor techniques and microsystem techniques applied for the first example, the accuracy has nevertheless been found to be amply sufficient for the purpose of thus manufacturing a suitable atomizing device in serial production at a relatively low cost price.

A third exemplary embodiment of an atomizing body of an atomizing device according to the first aspect of the invention is shown in FIG. 4B. The atomizing body here comprises two almost identical parts 10,20, which each comprise a half of the final structure. This structure is for instance arranged by etching or cutting in a surface of a starting substrate, for instance of glass or silicon, for the purpose of forming wall parts 12A,13A,14A and 12B,13B,14B respectively thereon. Provided here on a delivery side are parts of outflow ports 18A and 18B respectively from which liquid jets escape from a liquid cavity 15 during operation, which jets intersect each other at an intersection outside a spraying space 17 on a side of liquid chamber 15 remote from the liquid chamber. The parts of the atomizing body are then placed with their structured side onto each other and glued together to form a hermetic whole. Spraying space 17 is then bounded on opposite sides by a bottom 11 and roof 21, which are formed respectively by the two constituent parts 10,20 of the atomizing body. Instead of two almost identical structured parts, use can otherwise also be made of two structured parts with a different division of the eventual final structure, and a different starting material can, if desired, be applied for both parts.

For the forming of an atomizing body from plastic use can optionally also be made of modern modelling techniques such as stereolithography and rapid prototyping, wherein, using a microprocessor-controlled laser, the atomizing body can be directly written three-dimensionally in optionally integral form in a (resin) liquid adapted thereto or be imaged therein using a set of masks, whereby the liquid cures locally in order to form the body. It is possible here to opt to form the bottom part separately from the roof part, although the whole atomizing body can also be formed as a monolithic whole from the resin in one operation. An example hereof is shown in FIGS. 4C and 4D on the basis of a fourth exemplary embodiment of an atomizing body of an atomizing device according to the first aspect of the invention.

The figures here show the atomizing body from opposite perspective directions. The atomizing body thus comprises one monolithic whole 10 in which the desired vaporizing structure is imaged and formed using the above described techniques.

In addition to being embodied as a chip-like body which can be placed in a suitable envelope for handling purposes, the atomizing body can also be embodied as a larger whole which can for instance already be applied per se in a nebulizing device. A fifth exemplary embodiment of the atomizing device according to the invention gives an example hereof and is shown in FIGS. 5A-C. The nebulizing device here comprises an assembly of a set of plastic parts 10,20, wherein a first part 10, see also FIG. 5C, forms a base with an inlet 16 which can be brought into open communication with pressure means, and a second part 20 is arranged thereon by way of a cover. Together these components 10,20 form a complete actuator for connection to the stem of a pump or spray can. A micro-channel structure with outflow ports is realized here in a main surface of upper part 20 directed toward the base part simultaneously with forming of this part by injection moulding, see also FIG. 5B.

Both components 10,20 are manufactured with high precision by moulding (injection moulding) from a suitable plastic such as polycarbonate or an amorphous plastic, such as particularly a transparent, amorphous copolymer of both cyclical and linear olefins, commercially available under the name TOPAS COC. With this combination of material and technique micro-structured channels 16,18 with a width and depth in the order of 20 to 50 micrometers are feasible. Relatively high-quality nebulizers, which are for instance suitable for perfume and deodorant sprays, can thus be realized at relatively low cost price.

Arranged here with high precision on a main surface 21 of second part 20 directed toward base part 11 is a surface structure, which is shown in more detail in a bottom view of FIG. 5B. This surface structure comprises all operational parts of the nebulizing device, i.e. in addition to an inlet 16 in open communication with inlet 16 of base part 10 also a liquid chamber 15 which debouches in a vaporizing space 17 on a delivery side via a set of outflow ports 18 and outflow openings 19 corresponding therewith.

The two parts 10,20 are hermetically connected to each other by means of thermo-bonding and then form a non-breakable closed whole as shown in FIG. 5A. The two parts, accurately aligned with each other with a tolerance in the order of a micrometer, are herein pressed several micrometers into each other in order to ensure a durable adhesion and leakage-tight fusing. The product is optionally also shortened locally with for instance a water jet, laser, scratching, breaking or other technique. Protrusion 17 here also forms a vaporizing space which at least practically eliminates the influence of such a separating technique on the final vapour pattern. The thus obtained assembly can be applied directly as spray nozzle of a nebulizing device.

An atomizing body of a sixth embodiment of an atomizing device according to the invention is shown respectively in perspective view and in cross-section in FIGS. 6A and 6B. On a delivery side this atomizing body comprises a wall part 10 with adjacently thereto a roughly semi-cylindrical vaporizing space 17 in which a set of outflow ports 18 debouches, see FIG. 6A. Vaporizing space 17 is here bounded on all sides by wall part 10 and thereby separated from a liquid chamber 15 in the atomizing body. The liquid chamber is supplied, at least during operation, with a liquid under pressure from an inlet 16. The set of outflow ports 18 are positioned relative to each other such that outflowing liquid jets intersect each other at an intersection which lies outside vaporizing space 17.

In this example wall part 10 comprises an insert, although it can optionally also be formed monolithically with adjacent part 20 of the atomizing body. Just as the other part 20 of the atomizing body, the insert can be manufactured from various materials, including particularly metals in addition to semiconductor materials, glass and plastic. In this example use is made of metal and the wall part comprises a plate-like metal part brought into the shown form with semi-cylindrical vaporizing space 17 via punching. Outflow ports 18 typically have a diameter of 20-50 micrometers and can be arranged in standing part 10 by means of electroforming or etching.

FIGS. 7A and 7B show an atomizing body of a seventh embodiment of an atomizing device according to the invention in respectively perspective view and cross-section. On a delivery side the atomizing body comprises a wall part 10 with adjacently thereto a concave vaporizing space 17 which is bounded all around by the wall part. According to the invention the vaporizing space 17 here extends beyond a set of outflow ports 18 which debouches therein on either side, see FIG. 7A. On an opposite side the wall part 10 bounds a liquid chamber 15 which is supplied during operation with a liquid under pressure from an inlet 16. Ports 18 are positioned relative to each other such that outflowing liquid jets intersect each other outside vaporizing space 17.

In this example wall part 10 also comprises an insert, although it can, if desired, also be formed monolithically with adjacent part 20 of the atomizing body. Just as the other part 20 of the atomizing body, the insert can be manufactured from various materials, including particularly metals in addition to semiconductor materials, glass and plastic. In the case of metal the cup-like, concave vaporizing space 17 is advantageously arranged in wall part 10 via punching. Such a concave form has an advantage relative to the cylindrical form applied in the previous example. This is because the outflow ports 18 in the concave form are always well aligned relative to each other so that the two liquid jets escaping therefrom will always strike each other properly. Although the overall jet pattern may then be slightly askew, this is not of real significance for many applications. In the case of other forms, such as a punched right angle or a cylindrical shape, the alignment is more critical.

For a practical final finishing the atomizing body 1 of an atomizing device, according to an embodiment of a second aspect of the invention, is supplied in an envelope 40, see FIGS. 8 and 9. According to the second aspect of the invention, use is made for this purpose of an atomizing body which is electrically conductive and thereby able and adapted to capture electromagnetic radiation and generate heat. The atomizing body can here be manufactured as a whole at least largely from an electrically conductive material, such as a metal or a semiconductor material, or be covered with an electrically conductive coating.

In this example the envelope comprises two shell parts 41,42 manufactured from a thermoplastic plastic, such as a polyamide or a polyolefin, for instance by injection moulding. The shell parts are both provided with cavities 44 and protrusions or pins 45, and fit precisely to each other, guided herein by a fitting of the pins or protrusions 45 in cavities 44. Both shell parts herein lie round a shared vaporizing cavity 43 in which an atomizing body can be received in at least substantially fitting manner.

According to an embodiment of a method according to the invention, the atomizing body is placed in one of the two envelope parts 41 in vaporizing cavity 43 and positioned accurately therein. Envelope part 41 is joined together with the second envelope part 42 in order to close the whole. The thus obtained assembly is then subjected to an electromagnetic radiation or laser radiation of a selected nature and frequency at a sufficiently high power to cause the temperature of the atomizing body to increase in contact-free manner.

In the present example use is made for this purpose of microwave radiation at a frequency of about 2.5 GHz and a power of about 800 W. Within just seconds this results in a temperature increase on a boundary surface with the atomizing body in the order of several hundred degrees Celsius. At such a temperature the two thermoplastic envelope parts 41,42 fuse on at least the boundary surface with the atomizing body into a non-releasable, leakage-free whole. The thus enveloped atomizing body can for instance serve as spray nozzle in the atomizing device. On an inlet side the spray nozzle 40 comprises a cavity 46 which is in open communication with an inlet 16 of the atomizing body, while the spray nozzle is open on a delivery side in order to leave clear a system of outflow ports of the atomizing body.

Instead of being formed from two at least substantially symmetrical shell parts, such an envelope can also be formed from a base part 51 and a cap 52 fitting therein. An exemplary embodiment hereof is shown in FIGS. 10 and 11. Cap 52 here connects fittingly into a seating 53 in base part 51, in which an atomizing body 1 is received in at least substantially fittingly manner such that direct heat-exchanging contact with both envelope parts 51,52 is possible. Cap 52 thus encloses atomizing body 1 in seating 53. Use is also made in this case of envelope parts 51,52 of a thermoplastic plastic, which fuse at least locally under the influence of heat generated by the atomizing body when the whole is exposed to suitable electromagnetic or laser radiation. When the whole is exposed to such radiation, cap 52 and base part 51 melt together to form a non-releasable whole and base part 51 melts together seamlessly with atomizing body 1 at a boundary surface.

Cap 52 also forms a spacer part which is able and adapted to maintain under all conditions a distance from the seating 53 in which atomizing body 1 is enclosed. Atomizing body 1 hereby lies sufficiently recessed and protected in envelope 51,52 in order to prevent the vulnerable outflow ports 8 of an atomizing body 1 being able to come into contact with a part of another atomizing device during storage or transport. Instead of a continuous edge, as in this example, the spacer part can also comprise one or more protrusions, ribs or other profile on the top of the envelope, or be formed by a sufficient wall length from the top of the envelope to seating 53.

It is otherwise also possible to make use of an envelope of only a single envelope part, in which the atomizing body is accommodated and fixed in similar manner. An exemplary embodiment of an atomizing body with such an envelope is shown in FIGS. 12A and 12B. The atomizing body is here received fittingly in a seating 53 in envelope part 51, into which it can be placed via a window 54 provided on a front side, see FIG. 12A. According to the invention the whole is then exposed to radiation which is absorbed by the atomizing body, thus generating heat. In this example this is achieved by directing a laser at atomizing body 1 via window 54. A direct heat-exchanging contact between the atomizing body and the adjacent part of envelope 51 now brings about a local softening and melting of the envelope material so that it will connect seamlessly to atomizing body 1 and will form all around window 54 a collar 55 which further fixes atomizing body 1, see FIG. 12B.

FIG. 13 shows a further exemplary embodiment of an envelope for a vaporizing body of the nebulizing device according to the invention. The envelope here comprises a moulded plastic part 51 which is provided on a base with a so-called Luer coupling 59, with which the part can be coupled in standard manner to for instance a liquid container (not shown). On an upper surface the envelope part 51 comprises a seating 53 for fittingly receiving therein a plate-like atomizing body, for instance of the type as specified above. For envelope part 51 use is here also made of a thermoplastic plastic, which will melt under the influence of the heat which will develop when an atomizing body received in the seating is subjected to a suitable radiation as according to the invention.

In order to prevent an atomizing body, once it has been adhered in seating 53, later being pulled loose as a result of lateral shrink or expansion of a surrounding part 58 of the envelope, the seating is surrounded by an edge part 56 which is in turn separated by a groove 57 from the adjacent part 58 of the envelope. Groove 57 has a depth which is at least substantially equal to that of seating 53, for instance at least roughly two thirds as deep, and forms an effective interruption in pull in the unlikely event of lateral stress in envelope part 51.

Such a tension relief is also applied in the exemplary embodiment of an atomizing body according to the invention shown in FIGS. 14A-B in respectively perspective view and cross-section along line B-B. A plate-like atomizing body 1 is here placed on a main surface of a first envelope part 51 in a seating provided thereon for this purpose. A second envelope part 52 enclosing atomizing body 1 is arranged on first envelope part 51. Both parts are snapped together by means of a snap coupling 61 and joined together to form the spray nozzle shown in FIG. 14A with a vaporizing cavity 60 through which a transverse air flow can be carried along a delivery side of atomizing body 1. Second envelope part 52 here moreover protects the relatively vulnerable delivery side of the atomizing body from damage during (bulk) storage, handling and transport.

After being joined together in the manner indicated, the whole is subjected according to the invention to a suitable radiation source, whereby the atomizing body will be heated and will generate heat to the wall of the seating 53 with which it is in heat-exchanging contact. As a result hereof the material of the wall will melt round the atomizing body and enter into a durable and seamless adhesion therewith. The wall of seating 53 is in this case also formed by an edge part 56 which is separated from a further-removed part of the envelope by a surrounding groove 57 in order to provide pull relief as specified above. Groove 57 is here arranged on an underside, i.e. a side remote from a delivery side, of the atomizing body so that the delivery side can be completely flat and turbulences or other disruptions of said transverse longitudinal flow on the delivery side are limited to a minimum during operation. If desired, anchoring cavities (not shown) can be provided in atomizing body 1, for instance by etching such cavities therein, so that the melted envelope material penetrates therein and provides an additional adhesion.

Although the invention has been further elucidated above with reference to only a few exemplary embodiments, it will be apparent that the invention is by no means limited thereto. On the contrary, many more variations and embodiments are possible within the scope of the invention for the person with ordinary skill in the art.

The invention claimed is:

1. Atomizing device, comprising an atomizing body with at least one inlet for receiving a fluid under increased pressure and at least one outflow port for allowing the fluid to escape on a delivery side with forming of droplets formed at least partially therefrom, wherein the atomizing body is received in an envelope comprising at least one envelope part with at least a part of a seating for the atomizing body, characterized in that the atomizing body is susceptible to capture radiation and to convert it into heat, in that a boundary layer is present between the envelope and the atomizing body which has entered into heat-exchanging contact with the atomizing body to bring about a practically hermetic adhesion between the atomizing body and the envelope around the outflow port, and in that the envelope comprises at least two mutually connected envelope parts which are fused together at the position of the atomizing body.

2. Atomizing device as claimed in claim 1, characterized in that the at least one envelope part comprises a thermoplastic material, particularly a thermoplastic plastic, more particularly one from a group of polyolefins and polyamides, and that the boundary layer comprises a top layer of the envelope part which is melted around the atomizing body.

3. Atomizing device as claimed in claim 2, characterized in that the boundary layer comprises a thermosetting glue layer which is applied between the envelope part and the atomizing body and which, in hardened state, connects the envelope part and the atomizing body.

4. Atomizing device as claimed in claim 1, characterized in that the seating comprises a recess on a main surface of the envelope part for the purpose of receiving the atomizing body at least partially therein, and in that an edge of said recess extends over the atomizing body.

5. Atomizing device as claimed in claim 4, characterized in that the atomizing body is at least substantially plate-like and is bounded by at least substantially flat main surfaces onto which the at least one inlet and the at least one outflow port open, and that on the delivery side a main surface of the atomizing body at least substantially coincides with the main surface of the envelope part.

6. Atomizing device as claimed in claim 1, characterized in that the envelope part comprises on the main surface an edge part bounding the seating, and that the edge part is separated by a groove from a further-removed part of the envelope part.

7. Atomizing device as claimed in claim 6, characterized in that the groove has a depth which is at least substantially equal to a depth of the seating, in particular at least two thirds of the depth of the seating.

8. Atomizing device as claimed in claim 6, characterized in that the edge part at least substantially wholly surrounds the seating.

9. Atomizing device as claimed in claim 1, characterized in that the atomizing body comprises an electrically conductive material, in particular one from a group comprising metals and semiconductor materials, particularly silicon.

10. Atomizing device comprising an atomizing body with at least one inlet for receiving a fluid under increased pressure and at least one outflow port for allowing the fluid to escape on a delivery side with forming of droplets formed at least partially therefrom, wherein the atomizing body is received in an envelope comprising at least one envelope part with at least a part of a seating for the atomizing body, characterized in that the atomizing body is susceptible to capture radiation and to convert it into heat, in that a boundary layer is present between the envelope and the atomizing body which has entered into heat-exchanging contact with the atomizing body to bring about a practically hermetic adhesion between the atomizing body and the envelope around the outflow port, and in that the atomizing body is optically absorbent and that up to the atomizing body the envelope comprises at least a window which is substantially transparent to optical radiation.

11. Atomizing device comprising an atomizing body with at least one inlet for receiving a fluid under increased pressure and at least one outflow port for allowing the fluid to escape on a delivery side with forming of droplets formed at least partially therefrom, wherein the atomizing body is received in an envelope comprising at least one envelope part with at least a part of a seating for the atomizing body, characterized in that the atomizing body is susceptible to capture radiation and to convert it into heat, in that a boundary layer is present between the envelope and the atomizing body which has entered into heat-exchanging contact with the atomizing body to bring about a practically hermetic adhesion between the atomizing body and the envelope around the outflow port, in that the at least one envelope part comprises a thermoplastic material, particularly a thermoplastic plastic, more particularly one from a group of polyolefins and polyamides, in that the boundary layer comprises a top layer of the envelope part which is melted around the atomizing body, in that the boundary layer comprises a thermosetting glue layer which is applied between the envelope part and the atomizing body and which, in hardened state, connects the envelope part and the atomizing body, and in that the seating comprises a recess on a main surface of the envelope part for the purpose of receiving the atomizing body at least partially therein, and in that an edge of said recess extends over the atomizing body.

12. Method for manufacturing an atomizing device, wherein an atomizing body is placed in a seating in an envelope part in direct heat-exchanging contact with a boundary layer of said envelope part, characterized in that the atomizing body is subjected to radiation of a nature and frequency which is captured by the atomizing body to be converted into heat by the atomizing body, in that the atomizing body is fixed in the seating by allowing the boundary layer of said envelope part to enter into a durable connection with the atomizing body under the influence of the heat developed by the atomizing body, in that said seating is formed between a first envelope part and a second envelope part, which have a mutual contact surface and are joined together to form an assembly while enclosing the atomizing body, that envelope parts are used which comprise a thermoplastic plastic at least at the contact surface, and that the assembly is subjected to a treatment with said radiation in order to fuse together the assembly at least at the position of the atomizing body under the influence of the heat developed in the atomizing body.

13. Method as claimed in claim 12, characterized in that the atomizing body is placed in the seating via a thermally setting boundary layer and that the boundary layer is set under the influence of the heat developed in the atomizing body.

14. Method as claimed in claim 12, characterized in that use is made for the atomizing body of an electrically conductive material, in particular a metal or semiconductor material, and that the assembly is subjected to electromagnetic radiation, in particular microwaves, of a nature and frequency which at least substantially passes through the envelope part but which is captured by the atomizing body and converted into heat.

15. Method as claimed in claim 12, characterized in that use is made for the atomizing body of an optically absorbent material and that a high-energy light beam is directed at the atomizing body with a light source, in particular a laser.

* * * * *